US006954605B2

(12) United States Patent
Murakami et al.

(10) Patent No.: US 6,954,605 B2
(45) Date of Patent: Oct. 11, 2005

(54) TRANSFER DEVICE HAVING CASING WITH ELASTIC MEMBER

(75) Inventors: Susumu Murakami, Soraku-gun (JP); Minoru Tomiyori, Soraku-gun (JP); Yoshie Iwakura, Higashiosaka (JP); Hideshi Izumi, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 162 days.

(21) Appl. No.: 10/671,990

(22) Filed: Sep. 25, 2003

(65) Prior Publication Data

US 2004/0071483 A1 Apr. 15, 2004

(30) Foreign Application Priority Data

Oct. 10, 2002 (JP) ..... 2002-297624

(51) Int. Cl.[7] ..... B03G 15/16
(52) U.S. Cl. ..... 399/311; 399/316
(58) Field of Search ..... 399/45, 311, 316, 399/388, 389; 250/324–326

(56) References Cited

U.S. PATENT DOCUMENTS

| | | | | |
|---|---|---|---|---|
| 4,847,652 A | * | 7/1989 | Masuda et al. | 399/316 |
| 4,882,606 A | * | 11/1989 | Deguchi | 399/316 |
| 5,568,238 A | * | 10/1996 | Osbourne et al. | 399/311 |
| 6,101,361 A | * | 8/2000 | Karashima et al. | 399/316 |
| 6,314,265 B1 | * | 11/2001 | Kuermeier et al. | 399/317 |
| 6,640,078 B2 | * | 10/2003 | Ishii et al. | 399/316 |

FOREIGN PATENT DOCUMENTS

| | | | |
|---|---|---|---|
| JP | 54-150132 | * | 11/1979 |
| JP | 59-031983 | * | 2/1984 |
| JP | 03-138678 | * | 6/1991 |
| JP | 04-171463 | | 6/1992 |
| JP | 06-051652 | * | 2/1994 |
| JP | 06-308844 | | 11/1994 |
| JP | 08-211758 | * | 8/1996 |
| JP | 09-190092 | | 7/1997 |
| JP | 10-221972 | * | 8/1998 |
| JP | 2002-278314 | * | 9/2002 |

* cited by examiner

*Primary Examiner*—Robert Beatty
(74) *Attorney, Agent, or Firm*—David C. Conlin; David A. Tucker; Edwards & Angell, LLP

(57) ABSTRACT

A transfer device includes: a discharge type transfer element for transferring the developer to a sheet by discharging electric charge to a static latent image support through the sheet so as to form an image of an original thereon; and a transfer casing accommodating the transfer element, wherein the side on the sheet's entrance side is formed of an electrically insulating element, and is constructed such that the transfer element and transfer casing are arranged so as to be offset to the upstream side with respect to the rotational direction of the static latent image support, along the outer peripheral surface thereof and so that the upper end of the insulating element blocks up into the paper feed path, and the insulating element is adapted to be bent toward the sheet feed direction by virtue of an elastic member.

6 Claims, 4 Drawing Sheets

TRANSFER DEVICE HAVING CASING WITH ELASTIC MEMBER

BACKGROUND OF THE INVENTION (1) Field of the Invention

The present invention relates to a discharge type transfer device for transferring the developer to the paper so as to reproduce an image from an original, in particular relating to a transfer device which provides unvarying transfer performance regardless of the type of sheet, by perceiving the difference of sheet rigidity.

(2) Description of the Prior Art

Some transfer devices for use in electrophotographic image forming apparatuses such as copiers, printers and the like apply a transfer voltage by means of a transfer roller or transfer belt in order to transfer the developer (toner etc.) image onto an electrostatic latent image support (photoreceptor). Control of this transfer function is performed based on a constant-current system and is adapted to deal with change in transfer conditions within limits. For example, the control is made in accordance with change in the environmental conditions (high-temperature high-humidity, low-temperature low-humidity) of the image forming apparatus. However, the types of sheets used by the transfer device are diverse. For example, sheets with a paper weight of 50 g/m$^2$ to 250 g/m$^2$ may be handled.

Control of the transfer current in accordance with each sheet type is difficult to make by the above control, which results in causes of print failures and machine troubles.

To deal with this problem, some techniques for varying the transfer voltage applied to the transfer roller or transfer belt, depending on the environmental change of the image forming apparatus and the sheet type, based on the measurement of the transfer current value, have been proposed (see, for example, a patent publication 1: Japanese Patent Application Laid-open Hei 06-308844 ([0015] to [0018] on page 4, [0075] on page 9 and FIG. 1).

Other than the above, transfer devices using a corona discharger have been disclosed (see, for example, a patent publication 2: Japanese Patent Application Laid-open Hei 04-171463).

In the technique disclosed in the patent publication 1, the recording medium is fed into the transfer station where the transfer element is put in contact with the image support and the resistance at different points of the recording medium is determined at every predetermined interval based on the transfer current flowing through the transfer element, so that the transfer voltage is changed based on the result. Therefore, the transfer condition may change at the front part and the rear part over one sheet, causing difficulties in securing even printing quality. Further, since in the above publication technique, the transfer current needs to be measured at every predetermined interval so as to determine the transfer voltage based on the data, it is necessary to provide transfer tables for various environmental conditions in the controller of the image forming apparatus.

Further, for the recording media such as OHP sheets and the like, which have a volume or surface resistivity greatly different from usual, a recording media detecting means is needed so as to determine the type and set up different transfer conditions in accordance with the judgement. Thus, in order to make control involving the measurement of environment, the controller needs to implement markedly complicated control and store and handle a huge amount of data.

SUMMARY OF THE INVENTION

The present invention has been devised in view of the above problems, it is therefore an object of the present invention to provide a transfer device which uses a corona discharge technique that secures unvarying print quality, by achieving a transfer process in accordance with the sheet type with a simple configuration without the necessity of any complicated arrangement and complex control as conventionally needed.

In order to achieve the above object, the transfer device of the present invention is configured as follows:

In accordance with the first aspect of the present invention, a transfer device for use in an electrophotographic image forming apparatus, includes: a discharge type transfer element for transferring the developer to a sheet by discharging electric charge to a static latent image support through the sheet so as to form an image of an original thereon; and a transfer casing accommodating the transfer element, wherein the side on the sheet's entrance side is formed of an electrically insulating element, and is characterized in that the transfer element and transfer casing are arranged so as to be offset to the upstream side with respect to the rotational direction of the static latent image support, along the outer peripheral surface thereof and so that the upper end of the insulating element blocks up into the paper feed path, and the insulating element is adapted to be bent toward the sheet feed direction by virtue of an elastic member.

In accordance with the second aspect of the present invention, the transfer device having the above first feature is characterized in that the insulating element constituting the transfer casing is adapted to automatically change the angle of inclination thereof in accordance with the type of the sheet to be conveyed, in such a manner that the angle of inclination becomes greater when the sheet to be fed is thick (the sheet has a higher rigidity) and the angle becomes smaller when the sheet to be fed is thin (the sheet has a lower rigidity).

In accordance with the third aspect of the present invention, the transfer device having the above first feature is characterized in that the transfer voltage applied by the transfer element is fixed and the transfer electric field exerting the surface of the static latent image support via the sheet varies depending on the angle of inclination of the bent insulating element.

In accordance with the fourth aspect of the present invention, the transfer device having the above first feature is characterized in that the transfer electric field exerting the surface of the static latent image support is more converged when the sheet to be conveyed is thick than when the sheet is thin.

In accordance with the fifth aspect of the present invention, the transfer device having the above first feature is characterized in that, as to the point at which the sheet being conveyed is separated from the static latent image support, a thicker sheet is separated earlier (at a point closer to the transfer position) and a thinner sheet is separated later (at a point more distant from the transfer position).

In accordance with the sixth aspect of the present invention, the transfer device having the above first feature is characterized in that the upper end of the insulating element is beveled so as to be substantially parallel to the sheet feed path when the insulating element is inclined.

The transfer device of the present invention is provided for a copier, scanner or the like and provides the function of achieving transfer of toner images of an original formed on an electrostatic latent image support based on the electrophotography to recording media. In the conventional transfer device, the transfer element is positioned so as not to interfere with the paper feed path. On the contrary, in the transfer device of the present invention, the transfer element is arranged so as to be offset to the upstream side with respect to the rotational direction of the static latent image support, along the outer peripheral surface thereof and block up into the paper feed path. In this interfering arrangement in the paper feed path, the side face on the sheet's entrance side of the transfer casing is formed of an insulating element, and the insulating element is adapted to be repulsively bent in the paper feed direction by virtue of an elastic member.

Therefore, as a sheet of paper is fed into the paper feed path, the sheet abuts the upper end part of the insulating element so that the insulating element automatically becomes inclined in the paper feed direction in conformity with the rigidity of the sheet. For example, if a sheet having a high rigidity (e.g., a thick sheet) enters, the insulating element is inclined greatly, whereas it is inclined slightly when a sheet of a low rigidity (e.g., a thin sheet) enters. As soon as the sheet has passed therethrough, the insulating element returns to the original inclination from the repulsive force of the elastic member. In this way, the angle of inclination of the insulating element automatically changes depending on the strength of the rigidity of each sheet. As the insulating element inclines, so does the transfer electric field distribution in accordance with the inclination.

For example, when a sheet of a low rigidity is fed as mentioned above, the inclination of the insulating element is small. The transfer electric field produced by the transfer element is distributed approximately equal before and after the transfer position and is formed with relatively low density at the transfer position.

In contrast, when a sheet of a high rigidity is used as mentioned above, the inclination of the insulating element becomes large. Thereby, the transfer electric field produced by the transfer element is distributed in a narrower area before the transfer position and in a greater area after the transfer position and is formed to be relatively high in density at the transfer position. In this way, a stronger transfer field can be formed for a high rigidity sheet than for a low rigidity sheet. That is, the electric field becomes uneven with respect to the paper feed direction.

Consequently, since the strength of the transfer electric field varies depending on the inclination of the insulating element in conformity with the rigidity of the sheet even if a constant transfer voltage is continuously applied without regards to the sheet type, it is possible to assure the unvarying print quality without changing application of the transfer voltage in accordance with the sheet type as used to be done conventionally. Thus, it is possible to provide a simple configuration which can assure the unvarying print quality in conformity with the sheet type, without the necessity of providing complicated arrangements and processes as needed conventionally.

Further, in the transfer device of the present invention, since the upper end of the insulating element is beveled, the paper can be conveyed along the beveled surface. Therefore, it is possible to smoothly convey the sheet even if the upper end of the insulating element is arranged so as to abut the sheet in order to change the transfer electric field distribution as described above.

DESCRIPTION OF THE PREFERRED EMBODIMENTS

The embodiment of the present invention will hereinafter be described with reference to FIG. 1 to FIGS. 5A, 5B and 5C. It is noted that the present invention should not be limited to the description hereinbelow.

Figure 1:
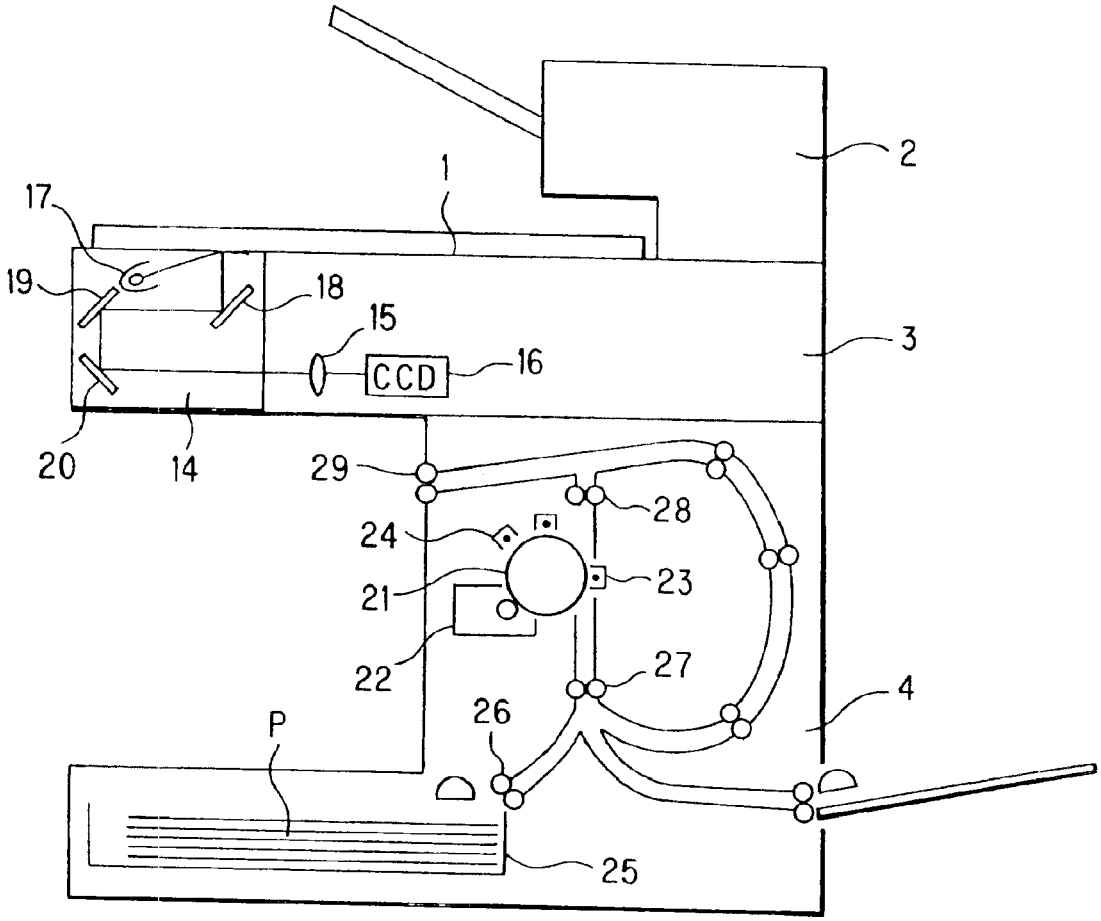
FIG. 1 is a sectional view showing a configuration of an embodiment of an image forming apparatus according to the present invention.

FIG. 1 is a sectional view showing an overall configuration of an image forming apparatus according to the present invention. As shown in FIG. 1, the image forming apparatus includes: an image reading unit composed of an original table 1, a document feed type image reader 2 and an image reading optical system 3; and an image forming portion 4. Image reading optical system 3 reads the image of an original placed on original table 1 or document feed type image reader 2, and includes a scanning unit 14, an image focusing lens 15 arranged in the optical path and a CCD (phototransducer) 16.

Scanning unit 14 illuminates the original and leads the reflected light from the original to CCD 16 by way of image focusing lens 15. Scanning unit 14 includes an exposure light source (light source) 17 for illuminating the original; a plurality of reflecting mirrors 18, 19 and 20 leading the reflected light from the original to CCD 16 through image focusing lens 15. When a document is read in the fixed document mode, scanning unit 14 scans and illuminates the document at a constant speed from left to right along original table 1. When a document is read in the document feed mode, the scanning unit is set stationary under the reading position of the document feed image reader 2 and irradiates the document with light.

Image data of the original thus picked up by CCD 16 undergoes various image processes through an unillustrated controller (control means) provided in image reading optical system 3.

The image data having been subjected to the image processes by the controller is transferred to an unillustrated laser scanning unit (to be called LSU hereinbelow) in image forming portion 4. Other than the LSU, image forming portion 4 includes a photoreceptor 21, a developing device 22, a transfer charger 23 made of a transfer element and a transfer casing, a main charger 24, a sheet tray 25, a pickup roller 26, a PS roller 27, a fixing roller 28 and a paper discharge roller 29 and others.

The LSU irradiates the photoreceptor 21 surface with a laser beam based on the image data, forming a static latent image on photoreceptor 21. This photoreceptor 21 has a drum-shape which is rotationally driven in the direction of the arrow. Around this photoreceptor 21, developing unit 22 for developing the static latent image formed on the photoreceptor surface by laser beam exposure into a visual image, transfer charger 23 for transferring the toner image on the photoreceptor to sheet P, main charger 24 for electrifying the photoreceptor to a predetermined potential and LSU for emitting laser beams toward the laser illuminated point on the photoreceptor are arranged from the laser illuminated point, in the order mentioned, in the rotational direction of the photoreceptor.

Sheets P are stored in sheet tray 25. Pickup roller 26 for delivering sheet P is laid out at the front end part of the sheet tray 25. When assuming the delivery side of sheet P is upstream and the output side downstream, a sheet entrance sensor switch, PS roller 27, transfer charger 23, fixing roller 28, a sheet output detecting switch (not shown) and paper discharge roller 29 are arranged downstream along the paper feed path. Sheet entrance sensor switch (not shown) detects passage of sheet P. PS roller 27, based on the signal from the sheet entrance sensor switch, registers the sheet with the toner image on the photoreceptor 21.

Fixing roller 28 fuses the toner image on the sheet P and fixes it thereto. The sheet output switch is located before the paper discharge roller and detects passage of sheet P. Paper discharge roller 29 discharges the sheet P thus formed with an image to the outside of the machine. Sheet P is discharged from the side of image forming portion 4, as shown in FIG. 1. That is, sheet P is discharged under the image reading optical system 3.

Next, the transfer technique implemented with transfer charger 23 of the image forming apparatus of the present invention will be described in comparison with the conventional transfer method.

To begin with, the structure of transfer charger 23 will be described.

Figure 4:
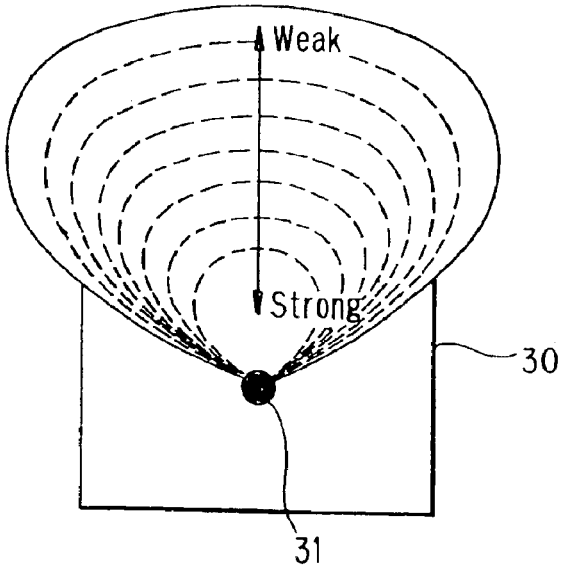
FIG. 4 PRIOR ART
FIG. 4 is a schematic sectional view showing a conventional transfer charger configuration and its charge distribution condition.
Figure 5A:
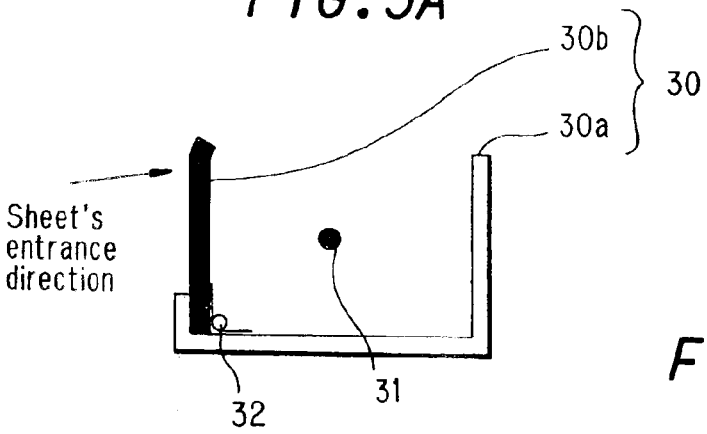
FIG. 5A is a schematic sectional view showing a transfer charger configuration used in the present invention.

FIG. 4 is a schematic sectional view showing the structure of the conventional transfer charger and its charge distribution, and FIG. 5A is a schematic sectional view showing the structure of the transfer charger used in the present invention. The conventional transfer charger is comprised of a top open transfer casing 30 and an electrode wire 31 arranged in the casing for applying a voltage to the photoreceptor side by corona discharge, as shown in FIG. 4. Since this transfer casing 30 is made of metal, when a fixed voltage is applied an electric field having a constant distribution is generated from electrode wire 31 towards the photoreceptor as shown in FIG. 4. The toner image on the photoreceptor is transferred to the paper by this effect. In this case, if the toner forming the image on the photo receptor is negative charged and charge of the opposite polarity, i.e., positive charge, is supplied from electrode wire 31, the toner image is caused to move and transfer to the paper by the effect of the electric field.

The conventional transfer charger is comprised of transfer casing 30 and electrode wire 31 as a transfer element as shown in FIG. 4. Transfer casing 30 is made of metal and shaped in a top-open box form. In contrast to this, the transfer charger of the present invention is comprised of a transfer casing 30, an electrode wire 31 and an elastic member 32, as shown in FIG. 5A. The side face of this transfer casing 30, located on the sheet's entrance side (front side) indicated by hatching, is formed of an electrically insulating element 30*b* and the remaining part of the transfer casing is formed of a metal member 30*a*. The insulating element 30*b* is supported by the transfer casing by means of elastic member 32 so that it can be bent toward the paper feed direction. For the material of electrically insulating element 30*b*, a resin plate of, for example, polyacetal (POM), polyamide (PA), polycarbonate (PC) and any other resin can be used as long as it is electrically insulative and can shield electric fields.

Figure 5B:
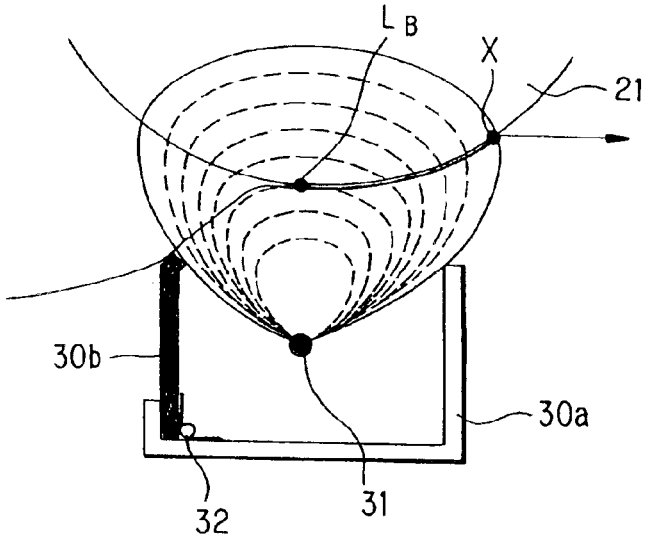
FIG. 5B is a schematic sectional view showing a situation when a sheet of a low rigidity (thin sheet) is conveyed through the transfer charger.
Figure 5C:
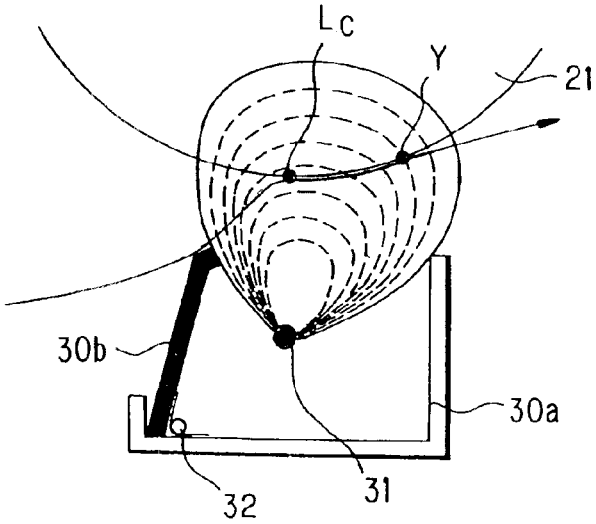
FIG. 5C is a schematic sectional view showing a situation when a sheet of a high rigidity (thick sheet) is conveyed therethrough.

In the drawings shown in FIGS. 5A, 5B and 5C, insulating element 30*b* forming the side face of transfer casing 30, on the sheet's entrance side, is fixed in such a manner that its lower part is arranged on the inner wall side and fixed to the inner bottom face of metal member 30*a*, perpendicular to the inner wall, by means of elastic member 32. However, the position of fixture with the elastic member is not particularly limited. For example, the insulating element 30*b* may be fixed so that its lower part is arranged on the outer wall side and fixed to the outer side face of metal member 30*a* by means of elastic member 32.

Further, though the elastic member 32 illustrated is of a coil spring type, it is not limited thereto. Other than this, an elastomeric member can be used. By this arrangement, insulating element 30*b* of transfer casing 30 is able to be inclined in the paper feed direction. In other words, transfer casing 30 has a movable configuration whereby the insulating element side on the sheet's entrance side (i.e., the PS roller side) becomes inclined toward the paper feed direction.

Next, the position in which transfer charger 23 is disposed will be explained.

Figure 2:
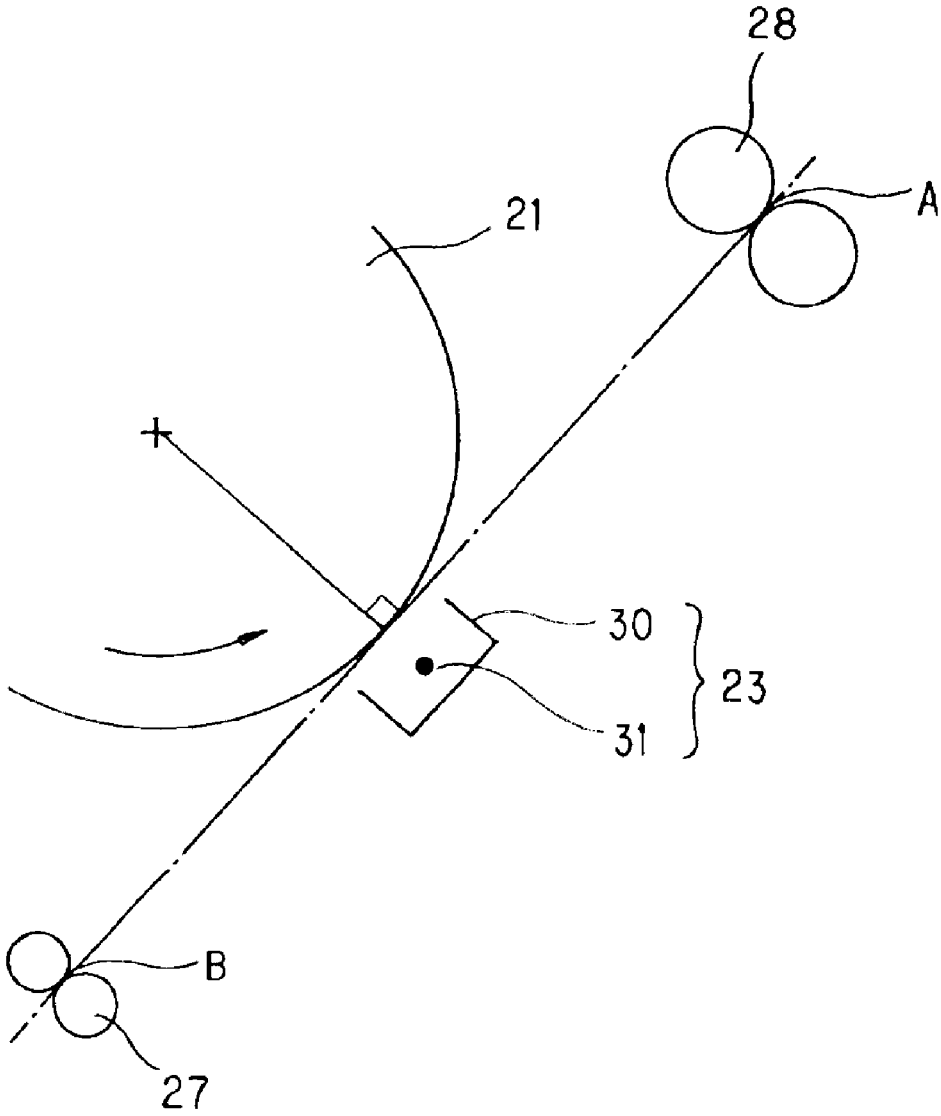
FIG. 2 PRIOR ART
FIG. 2 is a sectional view showing a conventional arrangement of a photoreceptor and a transfer charger.
Figure 3:
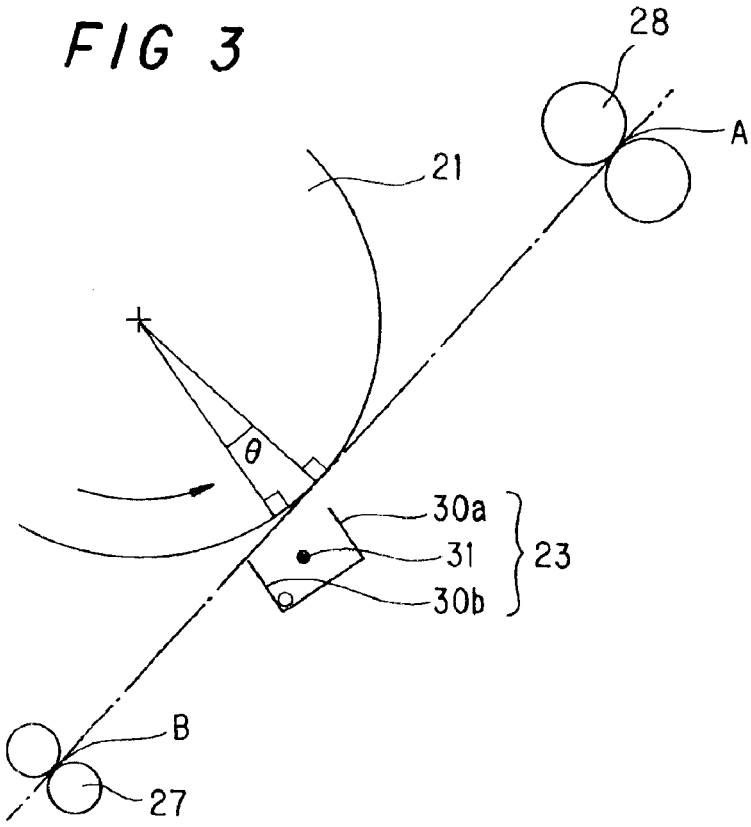
FIG. 3 is a sectional view showing an arrangement of a photoreceptor and a transfer charger in the present invention.

FIG. 2 is a sectional view showing the arrangement of photoreceptor 21 and transfer charger 23 of the conventional configuration. FIG. 3 is a sectional view showing the arrangement of photoreceptor 21 and transfer charger 23 of the present invention. First, as shown in FIG. 2, in the conventional transfer charger 23 configuration, photoreceptor 21 is arranged so that its outer peripheral surface is put in contact with the paper feed path (i.e., the straight line represented by a dashed line that joins between the nip A of fixing roller 28 and the nip B of PS roller 27 shown in FIG. 2). The transfer charger 23 is kept out of contact with photoreceptor 21 and arranged in parallel to the paper feed path. Further, the electrode wire 31 of the transfer charger 23 is positioned on the extended line of the line segment joining the center of photoreceptor 21 and the contact point between photoreceptor 21 and paper feed path. That is, the line joined between the center of photoreceptor 21 and the wire 31 or the axial center of the transfer charger 23 and the paper feed path intersect at right angles (at an angle of 90°). Therefore, the conventional transfer charger 23 is arranged so as not to interfere with the paper feed path.

In contrast to this, in the configuration of the present invention, photoreceptor 21 is arranged in the same manner as the conventional configuration so that its outer peripheral surface is put in contact with the paper feed path as shown in FIG. 3, but the transfer charger 23 is positioned offset to the upstream side with respect to the rotational direction of photoreceptor 21 along the outer peripheral surface thereof, so that its upper end of insulating element 30*b* of transfer casing 30 blocks up into the paper feed path. That is, the transfer charger is displaced by an angle θ along the outer peripheral surface of photoreceptor 21 toward the PS roller 27 side. And, the casing with wire 31 is directed toward the center of photoreceptor 21 while the line joining the center of photo receptor 21 and wire 31 and the paper feed path intersect with each other, not at right angles, but at an angle of less than 90°.

Thus, the transfer charger of the present invention is different from the conventional configuration in that it is set off from the conventional position to the PS roller side, or to the upstream side with respect to the rotational direction of the photoreceptor so as to block into the paper feed path, and in that the insulating element of the transfer charger 30 is positioned within the paper feed path. Accordingly, when a sheet is fed to the paper feed path, the sheet comes into contact with insulating element 30*b* first. Since the insulative side 30*b* can be inclined in the paper feed direction owing to the function of elastic member 32, the angle of inclination varies depending on the type of paper (e.g., thickness, rigidity etc.).

FIG. 5B shows a case where a sheet having a low rigidity (thin sheet) is conveyed. The uni-directional arrow in FIG. 5B shows the route of the sheet conveyance. Conveyance of a low-rigidity sheet will produce a small thrust pressure. Therefore, insulating element 30*b* of the transfer charger is little inclined. As a result, the transfer charger creates an electric field distribution shown by the fan-shaped solid and broken lines, which is almost the same as the conventional electric field distribution shown in FIG. 4. That is, the transfer electric field produced by wire 31 is substantially equal in the areas before and after the transfer position $L_B$ and relatively low in density at the transfer position $L_B$. Therefore, the transfer width, i.e., the area in which the voltage is applied during passage of the paper through the transfer charger 23 becomes greater than the width of the transfer casing.

On the other hand, FIG. 5C shows a case where a sheet having a high rigidity (thick sheet) is conveyed. Conveyance of a high-rigidity sheet will produce a large thrust pressure. Therefore, insulating element 30*b* of the transfer charger is greatly inclined in the paper feed direction. As a result, the transfer charger creates an electric field distribution, which is deviated from that of the case of a small-rigidity sheet, as shown by fan-shaped solid and broken lines in FIG. 5C. That is, the transfer electric field produced by wire 31 is distributed in a narrower area before the transfer position $L_C$ and in a greater area after the transfer position $L_C$, and is formed to be relatively high in density at the transfer position $L_C$.

Therefore, the transfer width, i.e., the area in which the voltage is applied during passage of the paper through the transfer charger 23 becomes shorter than the width of the transfer casing. That is, the transfer voltage is applied in a shorter period of time than that for the case of a low-rigidity sheet. In this manner, the transfer electric field can be condensed when a thick sheet passes, whereby it is possible to improve the transfer efficiency for the fed sheet.

Comparing the transfer electric field at the transfer position $L_B$ in FIG. 5B and that at the transfer position $L_C$ in FIG. 5C, the latter for the thick sheet is higher in density than the former for the thin sheet. As to the point of separation from the photoreceptor, the latter, thick sheet separates from the photoreceptor at an earlier point (Y in FIG. 5C, closer to the transfer position $L_C$) and the former, thin sheet separates at a later point (X in FIG. 5B, more distant from the transfer position $L_B$).

In sum, in the case where the transfer electric field is kept constant for all types of sheets regardless of whether the sheet is thick or thin as in the conventional method, a required strength of transfer electric field cannot be obtained for a thick sheet of paper, unlike the case of the present invention, hence degradation of transfer performance (such as internal voids in characters, transfer failures in halftones, etc.) takes place, thus lowering the print quality. In contrast, in the present invention, since a required condensation of transfer electric field can be achieved depending on the thickness (rigidity) of the sheet to be conveyed, it is possible to reduce the occurrence of printing defects. That is, when the rigidity of the paper is weak, the transfer electric field distribution becomes substantially equal before and after the transfer position so as to apply a lower transfer field. When the rigidity of the paper is strong, a strong transfer field is applied intensively in a short period of time.

In other words, the transfer electric field distribution spreads over a winder range for a sheet of a low rigidity while the electric field density becomes lower than that for a sheet of a high rigidity. In this way, the transfer charger 23 is able to change the distribution and density of the transfer electric field depending on the type of paper.

In the above way, it is possible to change the intensity of the transfer electric field by making use of the inclination or flexible movement of the insulating element in accordance with the paper rigidity even if a constant transfer voltage is continuously applied without regards to the type of paper. As a result, it is possible to achieve unvarying transfer performance, stable paper separation from the photoreceptor and elimination of the problem of internal voids in characters and other problems without making any change of the applied transfer voltage, which has been changed in accordance with the type of paper in the conventional configuration. Further, since the transfer charger of the present invention uses elastic member 32, the insulating member 30*b* reverts itself back from the inclined position to the original position by the repulsive force of elastic member 32 as soon as the sheet has passed through it. Thus, the angle of inclination of insulating element 30*b* automatically changes in accordance with the rigidity of each paper.

As shown in FIGS. 5B and 5C, the insulating member 30*b* of the transfer casing preferably has a top end which is parallel to the paper feed direction when the insulating member 30*b* is set inclined. That is, it is preferred that the upper end of the insulating member 30*b* is beveled. With this arrangement, the paper is conveyed along the beveled surface of insulating element 30*b*. As a result, it is possible to smoothly convey the paper even with the transfer charger of the present invention of which the insulative part of the transfer casing is arranged so as to abut the paper.

As has been described heretofore, in the transfer device of the present invention, the insulating element arranged on the sheet's entrance side of the transfer charger is adapted to automatically bend in accordance with the type of paper (thin or thick), whereby it is possible to change the transfer electric field distribution and achieve a transfer process in conformity with the type of paper. Accordingly, it is no longer necessary to provide complicated arrangements such as a means for detecting the paper type, means for controlling the voltage depending on the paper type and other devices. Thus, no matter what type of paper is used, it is possible to automatically control the transfer electric field by inclining the side face of the insulating element when a constant voltage is applied to the transfer charger. Consequently, it is possible to provide a simple configuration which can assure the unvarying print quality in conformity with paper type.

What is claimed is:

1. A transfer device for use in an electrophotographic image forming apparatus, the transfer device comprising:

a discharge type transfer element for transferring the developer to a sheet by discharging electric charge to a static latent image support through the sheet so as to form an image of an original thereon; and a transfer casing accommodating the transfer element, wherein the side on the sheet's entrance side is formed of an electrically insulating element, characterized in that the transfer element and transfer casing are arranged so as to be offset to the upstream side with respect to the rotational direction of the static latent image support, along the outer peripheral surface thereof and so that the upper end of the insulating element blocks up into the paper feed path, and the insulating element is adapted to be bent toward the sheet feed direction by virtue of an elastic member.

2. The transfer device according to claim 1, wherein the insulating element constituting the transfer casing is adapted to automatically change the angle of inclination thereof in accordance with the type of the sheet to be conveyed, in such a manner that the angle of inclination becomes greater when the sheet to be fed is thick (the sheet has a higher rigidity) and the angle becomes smaller when the sheet to be fed is thin (the sheet has a lower rigidity).

3. The transfer device according to claim 1, wherein the transfer voltage applied by the transfer element is fixed and the transfer electric field exerting the surface of the static latent image support via the sheet varies depending on the angle of inclination of the bent insulating element.

4. The transfer device according to claim 1, wherein the transfer electric field exerting the surface of the static latent image support is more converged when the sheet to be conveyed is thick than when the sheet is thin.

5. The transfer device according to claim 1, wherein, as to the point at which the sheet being conveyed is separated from the static latent image support, a thicker sheet is separated earlier (at a point closer to the transfer position) and a thinner sheet is separated later (at a point more distant from the transfer position).

6. The transfer device according to claim 1, wherein the upper end of the insulating element is beveled so as to be substantially parallel to the sheet feed path when the insulating element is inclined.

* * * * *